US006188324B1

(12) United States Patent
Meschkow et al.

(10) Patent No.: US 6,188,324 B1
(45) **Date of Patent: *Feb. 13, 2001**

(54) SHOELACE WARNING SYSTEM

(76) Inventors: Sasha H. Meschkow; Jordan M. Meschkow, both of 6105 E. Paradise La., Scottsdale, AZ (US) 85254

( * ) Notice: Under 35 U.S.C. 154(b), the term of this patent shall be extended for 0 days.

This patent is subject to a terminal disclaimer.

(21) Appl. No.: 09/532,498

(22) Filed: Mar. 22, 2000

(51) Int. Cl.[7] ..... G08B 21/00
(52) U.S. Cl. ..... 340/687; 340/686.1; 340/691.1; 340/573.1; 36/136
(58) Field of Search ..... 340/687, 686.1, 340/691.1, 692, 573.1, 665; 24/712; 36/136, 139, 137

(56) References Cited

U.S. PATENT DOCUMENTS

| | | | | |
|---|---|---|---|---|
| 3,898,641 | | 8/1975 | Banner | 340/280 |
| 5,357,696 | * | 10/1994 | Gray et al. | 36/136 |
| 5,373,651 | * | 12/1994 | Wood | 36/114 |
| 5,430,621 | | 7/1995 | Raskas | 362/32 |
| 5,566,479 | * | 10/1996 | Gray et al. | 36/137 |
| 5,718,021 | | 2/1998 | Tatum | 24/712.2 |
| 5,765,300 | * | 6/1998 | Kianka | 36/139 |
| 5,778,499 | | 7/1998 | Lehrman | 24/712 |
| 5,936,538 | | 8/1999 | Meschkow et al. | 340/687 |

* cited by examiner

*Primary Examiner*—Daniel J. Wu
*Assistant Examiner*—Phung Nguyen
(74) *Attorney, Agent, or Firm*—Jordan M. Meschkow; Lowell W. Gresham; Meschkow & Gresham, P.L.C.

(57) ABSTRACT

An untied shoelace warning system with a shoelace receiver and first and second sensors coupled to an indicator that activates when the system senses a shoelace segment, but senses it in an untied condition. The first and second sensors couple the indicator to a battery, and may all be contained within a housing. The first sensor is normally closed, but opens when a shoelace segment rests against it in a tied condition, and closes if the shoelace segment falls off the sensor, activating the indicator by coupling it to the battery. The second sensor is normally open, closing when it detects a shoelace segment. The system activates the indicator when a shoelace segment is not sensed by the first sensor, but is sensed by the second sensor. The system does not activate the indicator when a shoelace segment is not in the system, because neither the first nor the second sensor senses the shoelace. This way, the untied shoelace warning system does not activate the indicator when the shoe is not being worn. The indicator may be a sound device, e.g., a piezoelectric buzzer, a light or a series of lights, e.g., light emitting diodes or LED's, a vibrating device, or a combination of the aforementioned devices.

20 Claims, 2 Drawing Sheets

SHOELACE WARNING SYSTEM

TECHNICAL FIELD OF THE INVENTION

The invention relates to a shoelace warning system, particularly one that warns when shoelaces are untied.

BACKGROUND OF THE INVENTION

Walking in shoes with untied shoelaces can be a dangerous activity. Many injuries per year are inflicted on people that, while walking in shoes with untied laces, stepped on the laces, and thereby tripped and/or fell. Resulting injuries range from small cuts or bruises to broken bones or even a head injury.

Another problem with untied shoelaces is that stepping on them damages the lace ends. This occurs even if stumbling, falling, or injury does not result. This allows the lace to unravel which causes it to ruin, especially if the lace falls back from the last eyelet in the shoe. Re-inserting the lace end through the eyelet may not be possible.

Shoelaces are laced into shoes of all kinds and styles. No matter what the kind or style, however, shoelaces often come untied. Few people notice an untied shoelace until injury or damage to the lace has occurred.

Untied shoelaces are particularly prevalent with young children and their shoes. A young child may be between five and eight years old before they may effectively tie their shoelaces. Double-knotting shoelaces and shoes with hook-and-loop fasteners are employed to remedy the young child's lack of ability. Yet, even double-knotted shoelaces come untied, and a young one that can only tie shoelaces ineffectively, can expect the shoelaces to be untied again later.

The young child rarely notices an untied lace and even if he or she does, usually cannot tie the shoelace him- or her-self. Unaware of the problems and dangers of untied shoelaces, the child never asks an adult for assistance. Injury to the child or ruin to the shoelace is likely to occur.

SUMMARY OF THE INVENTION

Accordingly, an advantage of the present invention is that an improved untied shoelace warning system.

Another advantage of the present invention is that the untied shoelace warning system can be mounted in a housing, coupled to the front of the shoe.

Yet another advantage of the present invention is that the untied shoelace warning system can include a second sensor so that when a shoelace segment is not engaged with the system, the indicator does not activate.

The above and other advantages of the present invention are carried out in one form by a battery; an indicator; and a sensor configured to sense a shoelace and configured to activate said indicator by coupling said indicator to said battery, when a shoelace is not sensed by said sensor.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
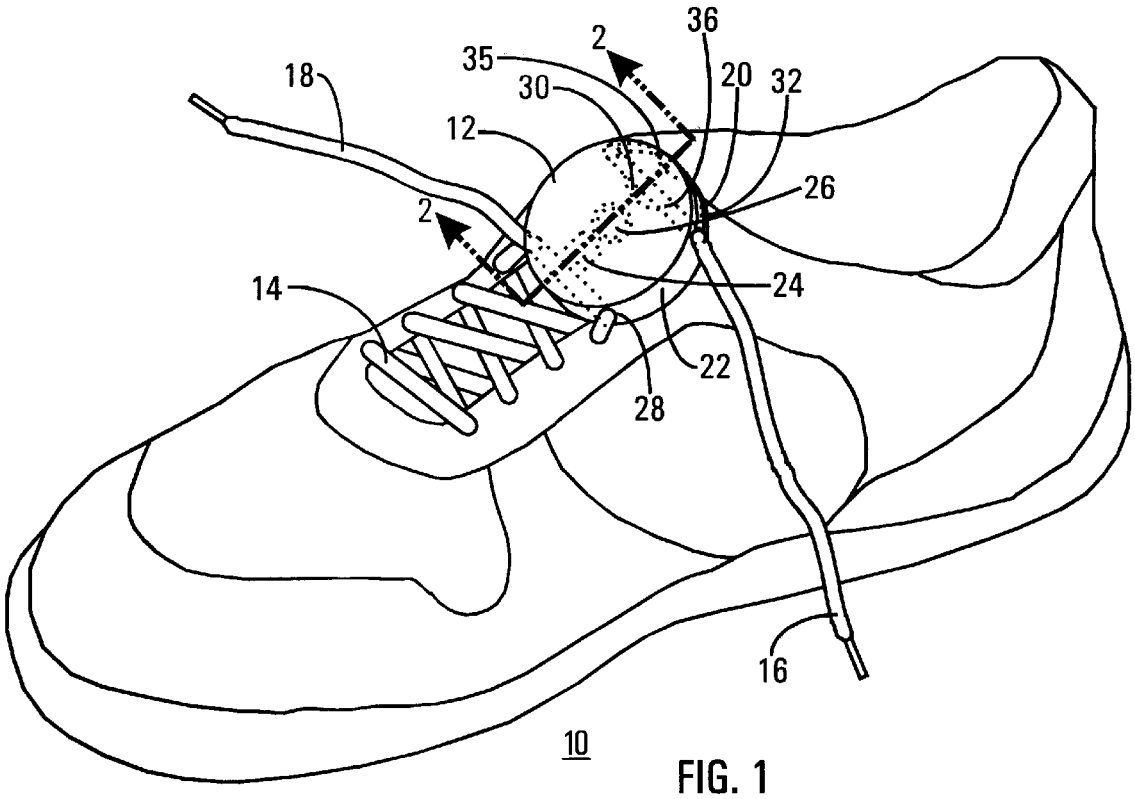
FIG. 1 shows a perspective view of a shoe with a shoelace warning system installed.

FIG. 1 shows a shoe 10 with shoelace warning system 12 installed therewith. As shown, shoelace warning system 12 has a housing 22. Mounted within housing 22 is indicator 24 and battery 26.

Shoe 10 has shoelace 14 laced thereon. As laced, shoelace 14 has opposing lace segments 16 and 18, which conventionally are tied together into a bow, to tie shoe 10 on a wearer's foot.

Figure 2:
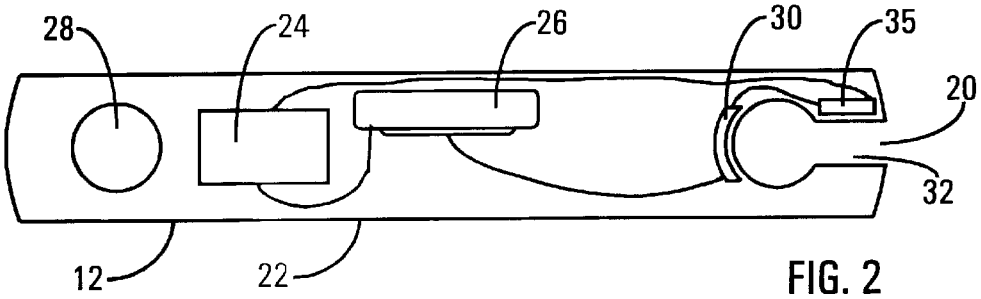
FIG. 2 shows cutaway view of the shoelace warning system taken at line 2—2 in FIG. 1.

Referring generally to FIGS. 1 and 2, housing 22 has a shoelace-segment-receiver, shown here as channel 20. Channel 20 has an opening 32 at the periphery of housing 22. When shoelace 14 is tied, shoelace segment 16 is run through channel 20, so that lace segment 16 is taut against a "shoelace-tied" position 36. With shoelace segment 16 taut against "shoelace-tied" position 36, shoelace 14 triggers a sensor 30. Sensor 30, which may be a pressure sensor or a momentary switch, is coupled between indicator 24 and battery 26, so that when pressure sensor 30 senses shoelace 14 in its shoelace-tied position 36, current from battery 26 does not flow to indicator 24.

In the preferred embodiment, indicator 24 may be a buzzer or beeping device such as a piezoelectric buzzer. It may also be a light or a series of lights, e.g., light emitting diodes or LED's, a vibrating device, or a combination of a buzzer and/or the aforementioned devices.

Mounted near opening 32 is a second sensor 35, which may be a proximity sensor. As shown in the preferred embodiment proximity sensor 35 may be a mechanical momentary switch that senses the presence of shoelace segment 16. Proximity sensor 35 may also be an optical sensor. Proximity sensor 35 allows system 12 to activate indicator 24, when shoelace segment 16 is not in "shoelace-tied" position 36, but remains within channel 20. Proximity sensor 35 can also be configured to turn off system 12 when a shoelace is remote from system 12, and not within proximity of housing 22. Such shut-off capability of system 12 recognizes a "shoe-not-being-worn" condition, and conserves battery power.

Channel 20 has a C-shaped cross-section to hold system 12 on shoe 10, and to better hold segment 16 against sensor 30. In this way, if the shoelace become untied, the gradual loosening of lace segments 16 and 18, will pull segment 16 away from sensor 30, so as trigger indicator 24, but a gentle loosening of lace segments 16 and 18, while tied, will not. This will also cause system 12 to indicate an alarm, before system 12 may fall off shoe 10.

In order to prevent system 12 from falling off shoe 10, system 12 may also employ a second shoelace-segment-receiver, shown herein as hole 28. With a second shoelace segment 18 mounted through hole 28, system 12 is tethered to shoe 10, even if shoelace segment 16 becomes loose. This way system 12 would not be lost when segments 16 and 18 of lace 14 became untied.

In using system 12, a user would place shoelace segment 16 in channel 20, so that once the laces are tied, lace segment 16 of lace 14 is taut against shoelace-tied position 36. Here, shoelace 14 triggers sensor 30. Should lace 14 become untied, segment 16 would move from shoelace-tied position 36, thus triggering sensor 30, and allowing battery 26 to power indicator 24. Those skilled in the art will recognize that sensor 30 is in a "normally closed" position, switched into an "open" position, when shoelace segment 16 is against shoelace-tied position 36, and "closed" again, when shoelace segment 16 moves away from shoelace-tied position 36.

As noted above, system 12 may also have a second sensor 35 positioned at opening 32. Second sensor 35 may be a "normally open" momentary switch that senses that user has placed shoelace segment 16 of lace 14 in channel 20, and "activates" system 12, by powering sensor 30. Those skilled in the art will recognize that second sensor 35 is in a "normally open" position, switched into a "closed" position, when a shoelace segment 16 is within channel, and "open" again, when shoelace segment 16 is not within channel 20. In this way, when second sensor 35 does not sense shoelace segment 16, as in a "shoe-not-worn" condition, sensor 30 does not activate indicator 24.

Without second sensor 35, shoelace warning system 12 would sound, light-up, and/or vibrate when not worn because lace 14 is not generally tied when shoe 10 is off the wearer's foot. Alternatively, an on/off switch (not shown) may be employed to disengage system 12 when system 12 is not in use.

Figure 3:
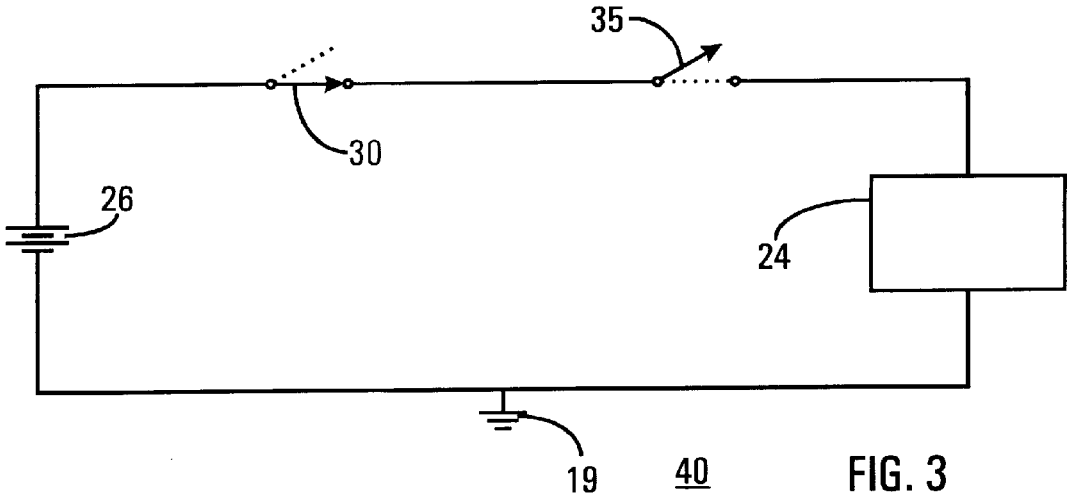
FIG. 3 shows a schematic diagram of a circuit for the shoelace warning system.

FIG. 3 shows circuit 40 with battery 26, sensor 30, sensor 35, and indicator 24. As shown in FIG. 3, all components may be mounted in series, but those skilled in the art can recognize that circuit 40 could be configured differently. This would be necessary where sensor 35 is configured to power on and off sensor 30.

Figure 4:
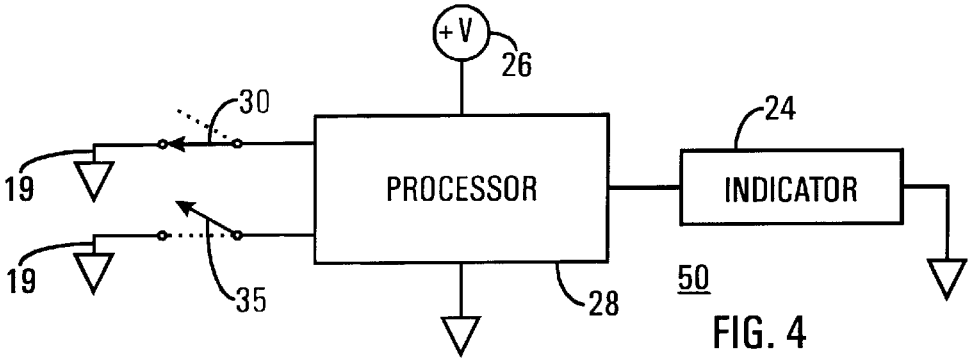
FIG. 4 shows a block diagram of a second circuit for the shoelace warning system, using a microprocessor.

A microprocessor circuit may be used to make shoelace warning system 12. FIG. 4 shows microprocessor circuit 50 with a microprocessor as controller 28 having pins for battery or power 26 and ground, another pin for sensor 30, which goes to ground 19, another pin to connect to indicator 24, which goes to ground, and another pin to connect for second sensor 35, which goes to ground 19.

Figure 5:
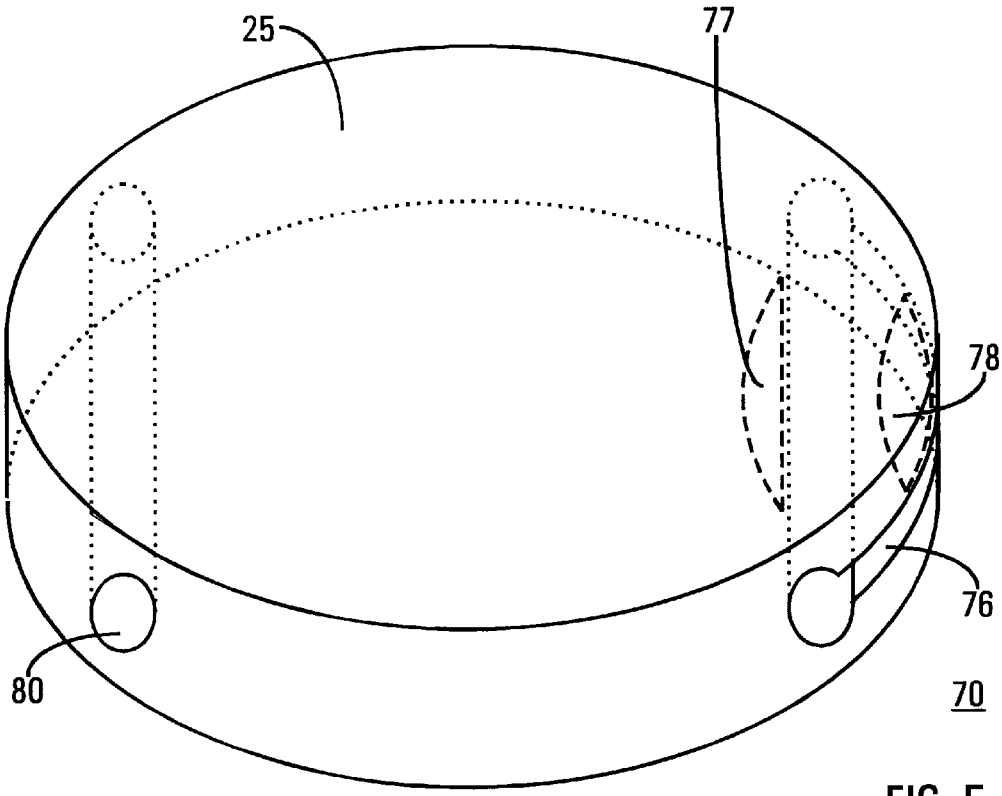
FIG. 5 shows the shoelace warning system in kit form.

FIG. 5 shows shoelace-warning kit 70. Kit 70 may be sold to retrofit existing shoes with shoelace warning system 12.

Kit 70 has decorative medallion 25, which has channel 76, sensor 77, second sensor 78, and second shoelace segment mounting hole 80. Mounted within medallion 25 are a battery and an indicator (not shown).

In summary, the present invention provides a shoelace warning system that can be mounted on the top of shoe, and attached directly to its existing shoelaces so it can be used with any type of lace-up shoes. The invention is simple and inexpensive to manufacture, simple to operate, and convenient to use. It saves people from injury or embarrassment due to falling or tripping. It has a sensor, which senses a shoelace segment to arm the system. It has another sensor, which causes the system to indicate an untied shoelace condition.

Although the preferred embodiments of the invention have been illustrated and described in detail, it will be readily apparent to those skilled in the art that various modifications may be made therein without departing from the spirit of the invention or from the scope of the appended claims. For example, various indicators or sensors may be used, and different wiring schemes can be adopted. Even different batteries or power devices can be adapted.

Having disclosed my invention such that anyone skilled in art could make the invention from this disclosure, we claim:

1. A shoelace warning system comprising:

a battery;

an indicator;

a sensor coupled to said battery and said indicator, configured to sense a shoelace and to activate said indicator when a shoelace is not sensed by said sensor.

2. The shoelace warning system of claim 1 further comprising a second sensor, coupled to said sensor.

3. The shoelace warning system of claim 2, wherein said second sensor is configured to activate said indicator, when a shoelace is sensed by said second sensor.

4. The shoelace warning system of claim 1 further comprising a shoelace-segment-receiver proximate said sensor, said shoelace-segment-receiver configured to receive a shoelace segment proximate said sensor.

5. The shoelace warning system of claim 4 wherein shoelace-segment-receiver comprises a housing for said indicator and said battery.

6. The shoelace warning system of claim 5 further including a second shoelace segment receiver, configured to receive a second shoelace segment to tether said system to a shoe.

7. The shoelace warning system of claim 4 wherein said shoelace-segment-receiver comprises a channel in said housing configured to receive a shoelace segment, said channel having an opening at a first end of said channel, and a shoelace-tied-position at a second end of said channel.

8. The shoelace warning system of claim 7 wherein when said sensor senses the presence of a shoelace segment at said second end of said channel, said indicator does not activate, and when said sensor does not sense the presence of a shoelace segment at second end of said channel, said indicator activates.

9. The shoelace warning system of claim 4 further comprising a second sensor, coupled to said sensor.

10. The shoelace warning system of claim 9 wherein said second sensor is configured to activate said indicator, when a shoelace is sensed by said second sensor.

11. The shoelace warning system of claim 10 wherein said second sensor is configured to sense the presence of a shoelace segment within said receiver at a position remote from said shoelace-segment-receiver, so that when said second sensor does not sense a shoelace segment, said indicator does not activate.

12. The shoelace warning system of claim 4 further including a second shoelace segment receiver, configured to receive a second shoelace segment to tether said system to a shoe.

13. The shoelace warning system of claim 1 wherein said indicator is selected from sound means, light means, and vibrating means.

14. The shoelace warning system of claim 1 wherein said sensor is selected from a pressure sensor, a proximity sensor, an optical sensor, and a momentary switch.

15. The shoelace warning system of claim 2 wherein said second sensor is selected from a pressure sensor, a proximity sensor, an optical sensor, and a momentary switch.

16. The shoelace warning system of claim 1 wherein said indicator is a piezoelectric buzzer.

17. A shoelace warning system comprising a battery, a proximity sensor configured to sense a shoelace segment, and an indicator;

Said proximity sensor and said indicator coupled to said battery, so that when said proximity sensor senses the presence of a shoelace segment, said indicator activates, and when said proximity sensor does not sense the presence of a shoelace segment, said indicator does not activate.

18. A shoelace warning system comprising:

a housing adapted to receive a shoelace at first and second portions thereof;

a battery within said housing;

an indicator within said housing;

a first sensor coupled to said housing proximate said first portion thereof; and a second sensor coupled to said housing proximate said second portion thereof;

wherein, said first sensor, said second sensor, said battery, and said indicator couple together so that said indicator is activated when second sensor detects that said shoelace is proximate said housing and said first sensor detects that said shoelace is untied.

19. A shoelace warning system as claimed in claim 18 wherein said first sensor, said second sensor, said battery, and said indicator couple together so that said indicator does not activate when said first sensor detects that said shoelace is tied, and said indicator does not activate when said second indicator detects that said shoelace is not proximate said housing.

20. A shoelace warning system as claimed in claim 19 wherein said second portion of said housing is a channel formed in a periphery of said housing, said indicator is a piezoelectric buzzer, said first sensor is a normally closed momentary switch, and said second sensor is a normally open momentary switch.

* * * * *